United States Patent [19]

Valenti et al.

[11] Patent Number: 4,595,621

[45] Date of Patent: Jun. 17, 1986

[54] SIMULATED EMBOSSING ON FLOOR COVERING

[75] Inventors: James P. Valenti, Lancaster; Eric C. Zirkel, Honey Brook, both of Pa.

[73] Assignee: Armstrong World Industries, Inc., Lancaster, Pa.

[21] Appl. No.: 665,575

[22] Filed: Oct. 29, 1984

[51] Int. Cl.[4] ..... B32B 27/04; B32B 27/30; B32B 31/12

[52] U.S. Cl. ..... 428/159; 428/156; 428/172; 428/203; 156/277; 156/313; 156/333

[58] Field of Search ..... 428/203, 156, 159, 172; 156/277, 313, 333

[56] References Cited

U.S. PATENT DOCUMENTS

| | | | |
|---|---|---|---|
| 1,691,708 | 11/1928 | Egleson | 428/203 X |
| 1,872,999 | 8/1932 | McCarthy | 428/203 |
| 3,399,106 | 8/1968 | Palmer et al. | 428/203 X |
| 3,725,184 | 4/1973 | Scopp | 428/203 |
| 4,187,131 | 2/1980 | Shortway et al. | 428/203 X |
| 4,214,028 | 7/1980 | Shortway et al. | 428/203 X |
| 4,409,280 | 10/1983 | Wiley et al. | 428/203 |
| 4,505,968 | 3/1985 | Ishii et al. | 428/203 X |

*Primary Examiner*—George F. Lesmes
*Assistant Examiner*—Nancy A. B. Swisher

[57] ABSTRACT

A method for providing a product which has a simulated embossed effect wherein a first wear layer is applied in a pattern and a second wear layer is deposited over the total surface that receives the first wear layer so that some areas of the surface have two wear layers and other areas of the surface have one wear layer to produce an embossed impression.

2 Claims, 2 Drawing Figures

SIMULATED EMBOSSING ON FLOOR COVERING

Background of the Invention

1. Field of the Invention

The invention is directed to a floor covering product, and more specifically, to a floor covering product that has a wear layer applied thereto to simulate an embossed-type floor covering product.

2. Description of the Prior Art

U.S. Pat. No. 4,054,699 discloses a method of sprinkling chips over a surface to form a pattern and then applying a coating of resin to that surface. A surface formed in such a manner could have the appearance of being an embossed surface.

U.S. Pat. No. 3,239,364 discloses the use of pieces of decorative material which are compatible with wear and base coatings. The decorative material is disclosed as being a metal foil. Again it is possible that such a structure might simulate an embossed effect.

SUMMARY OF THE INVENTION

The invention is directed to a floor covering product which has a base layer with an upper flat surface. On the flat surface there is provided a decorative design: A wear layer is placed over the decorative design and the wear layer is deposited as two separate layers or parts. The first part of the wear layer does not cover all of the decorative design, but is placed down with parts of the wear layer deposited being in register with parts of the design. The second part of the wear layer is then deposited over the top of the total upper surface of the base layer so that both the previously coated and uncoated surfaces of the decorative design are now covered by the second part of the wear layer. This yields a product which has a decorative design and thereover a wear layer which may in part be composed of just the second part of the wear layer coating and, in other areas, the wear layer is composed of both parts of the wear layer coating that was provided in the two separate coating steps. Naturally, the two-part coating will be thicker than the one-part coating and a simulated embossed effect is secured.

The method forming the above product is basically directed to the printing of the decorative design and then the printing of the first part of the wear layer followed by the applying of an overall wear layer coating to form the composite finished wear layer coating.

DESCRIPTION OF THE PREFERRED EMBODIMENT

Figure 1:
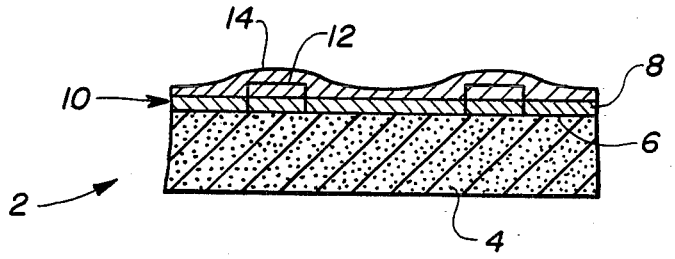
FIG. 1 is a cross-sectional view of the product formed by the invention herein.

The product is shown in FIG. 1 wherein the product 2 is composed of a base layer 4 which may have either a solid or foamed construction with or without filler materials. Such structures are old in the art wherein the base could be either a vinyl asbestos or vinyl floor tile product, it could be a sheet floor product which has a foamed vinyl backing or a base that has been formed from consolidated dryblend vinyl material. The base is a type of conventional base structure currently in use in the tile and sheet flooring art. The base has an upper surface 6 upon which is placed a printed design 8. The printed design may have design elements such that the total portion of the upper surface is printed with a design. It is quite possible that the coloration of the upper surface of the base could be utilized as the background color for the design and therefore certain areas of the upper surface would contain a design and other areas would not contain a design. It is conventional in the art to print designs on floor covering products and these are normally printed with vinyl inks by means of either a conventional rotogravure printing operation or through the use of transfer sheets which, through the use of heat and pressure, permit one to transfer a design from a transfer sheet to the base structure. Again, it is noted that this particular technique for providing a design on floor covering materials is old in the art. Over top of the printed design on the upper surface of the base 4 there is provided a wear layer 10 which is composed of two parts, the first part being element 12 and the second part being element 14. The wear layer 10 will cover the printed design and protect the design from wear when the floor covering product is in use. Normally, the total thickness of a wear layer would be anywhere from 10 to 30 mils in thickness.

Herein the wear layer 10 is placed on the printed design in two separate applying steps. The first part of the wear layer is applied by a printing process which places the wear layer coating on the upper surface of the base layer over at least part, but not all, of the decorative design and the printing being applied is normally in registration with some portion of the decorative design. This printing is shown as element 12 of FIG. 1. The coating 12 is applied by a conventional cell printer and it will provide the coating with a thickness of anywhere from 5 to 23 mils. The coating material that may be used is any UV curable coating and may be that disclosed in U.S. Pat. Nos. 4,420,499 or 4,138,299. As indicated previously, normally, the first part of the wear layer is applied in register with at least part of the printed design. It is possible through the application of multiple first-part layers to print wear layer coatings with different layers in and out of register. For example, if three separate first-part layers were printed in some areas, a first printing would be secured and then a second printing thereover where the second printing would be in register with only some portions of the first printing. There would then be a third printing wherein only some portions of the third printing are in registration with the second printing. This would yield areas where there is wear layer coatings of three different layers since some portions of the design would be covered with only the first printing and other portions could be covered with only the first and second printing or the first, second and third printing. This would thus provide printings of different heights. Also, subsequent printings could be of smaller sizes then the earlier printings and thus you would have a pyramid effect where the layers are in registration. The printing operation is carried out with the product moving at the speed of approximately 125 feet per minute and the type printer used is a conventional gravure type patterned cell containing roll printer.

After the first part of the wear layer has been applied, the product then moves to a conventional curtain coater which applies the second part of the wear layer coating. This coating will be 4 to 7 mils thick. That is, its thickness will be less than the first coating thickness. The second part of the wear layer coating will be placed on the upper surface of the base layer over all of the upper surface of the base layer to cover all the decorative design and even the first part of the wear layer coating. As seen in FIG. 1, the second part 14 of the wear layer coating is applied over the total upper surface 6. This coating would be the same as the first coating with simply its viscosity modified so that it could be applied as a curtain coating. Normally, the coating is applied at about 130°–140° F. with a viscosity of 80–1200 centipoise. This will prevent any flow of the coating from the top of the first layer printing to the valley areas between the first layer printing. This is necessary or else the second coating could just as soon fill in the area between the first area printings and yield a flat surface. This coating will then be UV-cured as indicated in the above-mentioned patent.

The first part of the wear layer which is printed can be printed with either a regular pattern shape or an irregular pattern shape. The printer could provide patterns of different sizes and shapes. The important thing to accomplish is to place normally the pattern of first wear layer material in register with the printed design. It is quite possible that it could be printed in register with certain portions of the printed design or it could be printed in register in areas just adjacent the printed designs. It is equally true that a pattern could be placed in registration from one printing to the next, but with the printing partly overlapping the design element and an adjacent design element. In effect, registration does not mean that there need be also absolute registration between a design element and a printing of the first part of the wear layer. What is important is that there be registration by means of a consistent location of a first-part wear layer printing in the same place relative to the design with each repeated design. It is also important that the first part of the wear layer be of a height which is greater than the thickness of the second part of the wear layer. The two layers must be proportioned such that the thickness of the first part of the wear layer and the second part of the wear layer, where they overlap, will have a height noticeably greater than the height of other areas where only the second part of the wear layer has been applied. Normally, the height differential between an area having just the second part of the wear layer versus an area that has both the first part and the second part of the wear layer will range from 1 mils to 20 mils.

The whole purpose of placing the wear layer down in a two-part operation is so that there will be secured an embossed like effect due to the fact that certain portions of the wear layer are of a greater thickness than other portions of the wear layer. Here there is secured a surface effect that appears to result from a mechanical embossing operation which has pressed the embossed design into the wear layer where, in reality, the embossed effect is simply secured by differential thicknesses of the wear layer coating which result from the application of the wear layer in two separate steps.

Figure 2:
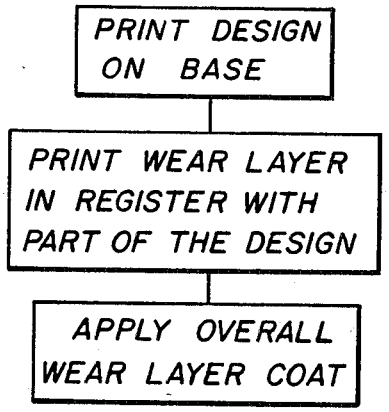
FIG. 2 is a schematic flow chart diagramatically showing the method of that invention herein.

FIG. 2 is a schematic showing of the method herein wherein there is first printed a decorative design on a base layer having an upper surface which is capable of receiving the decorative design. There is then printed the first part of a wear layer coating over at least part, but not all, of the decorative design in register with the decorative design. Finally, there is provided an overall coating of wear layer material over all of the upper surface of the base so as to cover all the decorative design and even the first part of the wear layer coating whereby over part of the decorative design the wear layer is composed of just the second part of the wear layer and over other parts of the decorative design, the wear layer is composed of both the first and second parts of the wear layer so that an embossed-like effect is secured.

What is claimed is:

1. A floor covering product comprising:

(a) a base layer of vinyl material in either solid or foam construction, with or without filler material, (b) the base layer having an upper surface and, on that surface, there being a printed decorative design on at least a part of the upper surface, (c) a wear layer coating means covering the printed design and protecting the design from wear when the floor covering product is in use, said wear layer coating means being a two-part coating comprising:

(1) a first thicker part of 5 to 23 mils thickness of the wear layer coating means being placed on the upper surface of the base layer over at least part, but not all, of the decorative design and being in register with at least part of the decorative design, and (2) the second thinner part of 4 to 7 mils thickness of the wear layer coating means being the same composition as the first part and being placed on the upper surface of the base layer over all the upper surface, so as to cover all the decorative design and even the first part of the wear layer coating means, whereby the wear layer coating means over part of the decorative design is composed of just the second part of the wear layer coating means and over other parts of the decorative design the wear layer coating means is composed of both the first and second parts of the wear layer coating means so that an embossed-like effect is secured.

2. A method of making a floor covering product comprising the steps of:

(a) printing a decorative design on a base layer having an upper surface which will receive the decorative design, (b) printing the first part of a wear layer coating over at least part, but not all, of the decorative design, and (c) applying the second part of the wear layer coating of the same composition as the first part over all the upper surface so as to cover all the decorative design and even the first part of the wear layer coating whereby over part of the decorative design the wear layer is composed of just the second part of the wear layer and over other parts of the decorative design the wear layer is composed of both the first and second parts of the wear layer so that an embossed-like effect is secured and wherein the first coating is of 5 to 23 mils in thickness and the second coating is thinner and of 4 to 7 mils in thickness.

* * * * *